US006537398B1

(12) United States Patent
Ljungars

(10) Patent No.: US 6,537,398 B1
(45) Date of Patent: Mar. 25, 2003

(54) METHOD FOR MANUFACTURING OF STRIPS OF STAINLESS STEEL AND INTEGRATED ROLLING MILL LINE

(75) Inventor: Sten Ljungars, Torshälla (SE)

(73) Assignee: AvestaPolarit AB (publ), Stockholm (SE)

( * ) Notice: Subject to any disclaimer, the term of this patent is extended or adjusted under 35 U.S.C. 154(b) by 0 days.

(21) Appl. No.: 09/868,503

(22) PCT Filed: Dec. 8, 1999

(86) PCT No.: PCT/SE99/02294

§ 371 (c)(1),
(2), (4) Date: Jul. 10, 2001

(87) PCT Pub. No.: WO00/37190

PCT Pub. Date: Jun. 29, 2000

(30) Foreign Application Priority Data

Dec. 18, 1998 (SE) ..... 9804443
Oct. 5, 1999 (SE) ..... 9903581

(51) Int. Cl.[7] ..... C21D 8/02; B21B 3/02
(52) U.S. Cl. ..... 148/651; 266/252
(58) Field of Search ..... 148/651; 266/252

(56) References Cited

U.S. PATENT DOCUMENTS 5,197,179 A 3/1993 Sendzimir et al.

FOREIGN PATENT DOCUMENTS

| | | |
|---|---|---|
| EP | 0 738 781 A1 | 10/1996 |
| EP | 0 837 147 A2 | 4/1998 |
| JP | 08024936 A | 1/1996 |
| WO | 95/24509 | 9/1995 |

*Primary Examiner*—Deborah Yee
(74) *Attorney, Agent, or Firm*—Nixon & Vanderhye

(57) ABSTRACT

A strip of stainless steel, which is cast and/or hot rolled and which is dark colored by oxides on the surface of the strip, remaining from the foregoing manufacture of said cast and/or hot rolled strips, is cold rolled in one or more cold rolling passes (11–13) following after each other, so that the thickness of the strip is reduced by 10–75% and so that the oxide scales crackle, i.e. so that fissures are established in the oxide layers. Thereafter, the strip is annealed in a furnace (18) having a furnace atmosphere obtainable by heating the furnace by means of burners which consume a liquid or gaseous fuel, which is combusted by means of a gas which contains at least 85 vol-% oxygen and not more than 10 vol-% nitrogen, wherein a furnace atmosphere is created, in which the strip can be annealed without oxidising the metal surfaces which are exposed through the crackling, in a way which would make the subsequent descaling and pickling difficult.

16 Claims, 2 Drawing Sheets

METHOD FOR MANUFACTURING OF STRIPS OF STAINLESS STEEL AND INTEGRATED ROLLING MILL LINE

TECHNICAL FIELD

The invention relates to a method for manufacturing of strips of stainless steel, comprising rolling in cold condition of strips which in a foregoing process have been manufactured through strip casting and/or have been hot rolled. The invention also relates to an integrated rolling mill line to be used at the carrying out of the method.

BACKGROUND OF THE INVENTION

Cold rolling of stainless steel strips is performed for one or several purposes. The basic purpose is generally to reduce the thickness of the starting strips, which normally have been hot rolled in a foregoing hot rolling line to a thickness of the hot rolled strips, which is not less than 1.5 mm and normally is in the order of 2–4 mm, but can be up to 6 mm. A main purpose or a secondary purpose of the cold rolling also may be to increase the strength of the strip material.

Usually, it is also a purpose of the treatment of the steel strip in the integrated rolling mill line to afford the strip certain surface features. The cold rolling, the annealing, and the pickling in this respect cooperate and have in different ways influence on the end result. It should in this connection be pointed out that the level of ambition as far as desired surfaces are concerned may vary very much. In some cases, a very fine, high gloss surface, a so called 2B-surface or finer, is desired. In other cases, a considerably more raw surface may be good enough, i.e. a beautifully pickled surface. The removal of scales, and pickling play an important role in this respect, whether the purpose is to produce a high gloss strip with a very fine surface, or a final product having that surface structure which is achieved after pickling but without subsequent skin-pass rolling, or other surface of good quality. It is particularly important that the scale residues can be easily removed without heavy blasting. The surface structure would generally be significantly impaired, if, e.g. a very powerful blasting would be required prior to the pickling.

Conventionally, initial annealing, cooling, and descaling through shot-blasting as well as pickling in one or more steps precede the cold rolling, for the achievement of a starting material for the cold rolling without oxides and scale residues from the foregoing hot rolling but often with defects because of powerful, scale-breaking shot blasting. As an alternative the hot rolling can completely or partly be replaced by manufacturing of strips through casting, which strips may have a thickness down to what is normal for hot rolled strips or be a few millimeters thicker, but also in this case the cold rolling normally is preceded by initial annealing, cooling, scale-breaking shot-blasting, and pickling, to the extent the technique has been implemented at all. At the cold rolling, which conventionally is carried out in a plurality of consecutive cold rolling operations, possibly alternating with annealing, cooling, descaling, and pickling operations, the thickness can be reduced down to 1 mm and in some cases to even thinner gauges. At the same time it is possible to produce, in these conventional cold rolling mills, strips with a very fine surface, a so called 2B-surface, if the rolling is finished by heat treatment, pickling, and skin-pass-rolling, or even finer if bright annealing is employed. Further is it known—U.S. Pat. No. 5,197,179 and EP 0 837 147—to perform at least a first cold rolling operation on the cooled hot rolled strip or on the cooled cast strip prior to heat treatment, pickling, and possible further cold rolling operations in order to bring the strip to desired final gauge. It is, however, characteristic for methods and rolling mill lines known so far that they are expensive and/or difficult to adapt to widely disparate requirements as far as strip thickness, surface conditions, and strength of the final product are concerned. This particularly applies when hot rolling and subsequent cold rolling, as well as operations in connection with the hot rolling and the cold rolling, are considered as an integrated process of production.

DISCLOSURE OF THE INVENTION

It is a purpose of the invention to attack and solve the above complex of problems. More particularly, the invention aims at facilitating the removal of oxides and scales from the cast and/or hot rolled steel strip, in which process the pickling constitutes an integrated part, by a treatment of the cast and/or hot rolled stainless steel strip prior to descaling and pickling, which treatment is characteristic for the invention. The invention is, however, not connected to any particular pickling technique. Generally, any pickling method, which is suited for pickling of stainless steels, can be employed in the method and the production line according to the invention.

These and other objectives can be achieved therein that the cast and/or hot rolled strip, which is dark coloured by oxides on the surfaces of the strips, remaining from the foregoing manufacturing of the said cast and/or hot rolled strip, is cold rolled in one or more consecutive cold rolling passes reducing the strip thickness by 10–75% and crackling the oxide scales, i.e. so that cracks are produced in the oxide scales, that the strip then is annealed in a furnace having a furnace atmosphere obtainable by heating the furnace by means of a burner, which consumes a liquid or gaseous fuel, which is combusted by means of a gas which contains at least 85 vol-% oxygen and not more than 10 vol-% nitrogen, whereafter the strip is cooled and subjected to at least any descaling operation and is pickled.

The initial cold rolling of the strip, which is dark coloured by oxides on the surfaces of the strip, remaining from the foregoing manufacture of the cast and/or hot rolled stainless steel strip, can be considered as an initial descaling operation, which can facilitate the efficient descaling that is performed later, after the annealing, but before the strip is pickled. In order that the said initial crackling shall be possible to be utilised efficiently in order to facilitate later descaling and pickling it is desirable that it as far as possible is not eliminated in connection with the annealing, i.e. so that fissures or cracks in the oxide layers do not heal up at the annealing. This desirable effect is to a considerable degree achieved therein that the strips are annealed in the specific atmosphere of the annealing furnace, which contains max 10 vol-% oxygen, preferably max 6 vol-% oxygen, while the main part consists of carbon dioxide, steam and a minor amount of nitrogen, which substantially emanates from air that possibly may leak in. A furnace atmosphere of that type can be achieved, e.g. through the technique which is disclosed in WO95/24509, the content of which herewith is incorporated in this text by reference. In the atmosphere of the furnace, which is poor of oxygen, the strip can be annealed at a temperature of 1050–1200° C. during such a long period of time that the strip will be through-heatened and be recrystallized without at the same time oxidising the metal surfaces, which are exposed because of the crackling, to an extent that it would make the subsequent descaling and pickling more difficult.

Different techniques of descaling can be employed without damaging the strip surfaces, because of the crackling of the scales in connection with the initial cold rolling of the strips in combination with the annealing in the furnace atmosphere that is poor of oxygen. Conventionally, descaling is carried out through powerful shot blasting in one or more steps, a treatment which however would cause the non-desired damages of the strip surfaces, if employed. According to an aspect of the invention, the descaling instead is carried out by bending the strip repeatedly in different directions about rolls, at the same time as the strip is cold-stretched, so that it is permanently elongated 2–10% prior to pickling according to a technique, which is known per se through EP 0 738 781. Through this treatment an efficient descaling is achieved without impairing the strip surfaces. This descaling can be completed by a mild blasting, which can be performed before or after the descaling, preferably before, aiming at removing only loose oxides in order, through accumulation of oxides, not do disturb subsequent descaling. If the blasting is carried out subsequent to the descaling it is correspondingly achieved that loose oxides are removed, the blasting in each case being carried out in such a mild way that the metallic surfaces of the strip are not impaired. Typically therefore, the descaling after annealing is completed through cold-stretching, wherein the strip is bent repeatedly about rolls, in combination with a gentle, not surface damaging, blasting before or after the cold stretching. Since the scales still are crackled after annealing and therefore easy to break, it is also conceivable to carry out the descaling through only a light blasting and brushing, or through cold stretching the strip plus brushing, or through only brushing.

Further characteristic features and aspects of the invention will be apparent from the appending claims and from the following detailed description of the invention. In this description will be explained how the invention can be employed in a number of different variants of rolling mill lines, in which the initial cold rolling of hot rolled strips or corresponding and the treatment of the strips between said initial cold rolling and pickling, as has been described in the foregoing is an integrated part. It should, however, be pointed out that the usability of the invention is not restricted to any of the described applications that can be used generally in connection with cold rolling of stainless steel strips.

DETAILED DESCRIPTION OF THE INVENTION

Figure 1B:
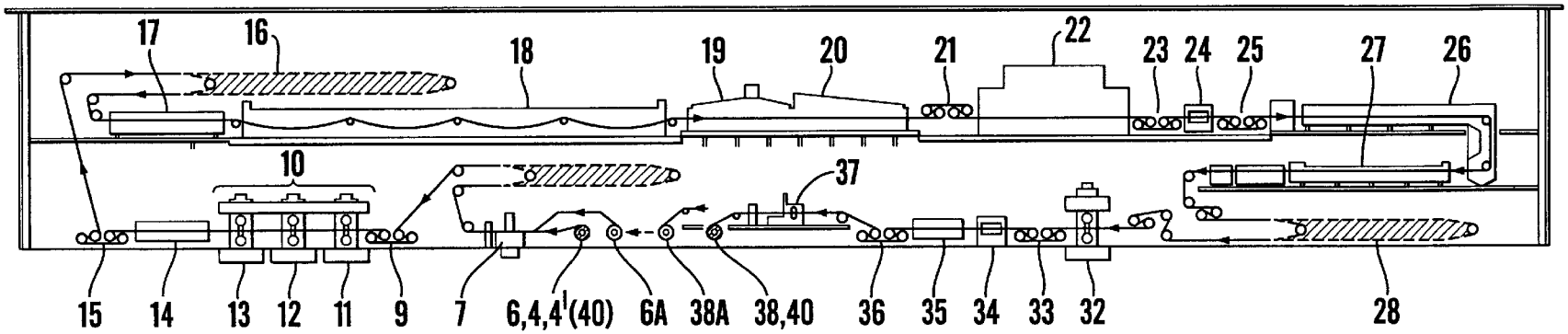
In FIG. 1 the invention and the said integrated rolling mill line is illustrated semi-schematically, and in FIG. 2 a preferred embodiment of the method for manufacturing cold rolled stainless strips, in which the method of the invention is an integrated part, is illustrated very schematically.
Figure 1A:
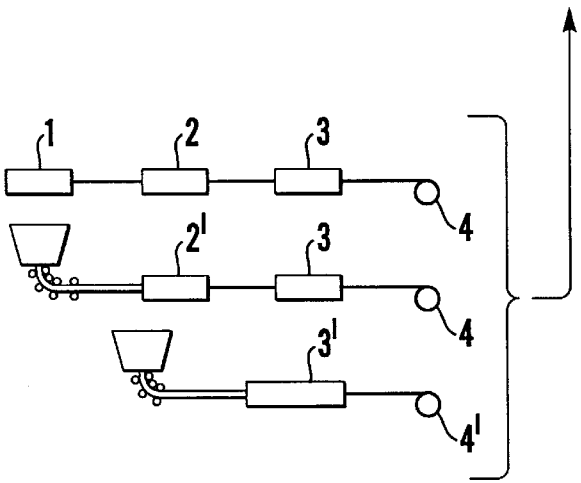

In the drawings, A schematically illustrates some different methods to manufacture the stainless strips, preferably strips of austenitic or ferritic stainless steel, which constitute starting material for the process in the subsequent rolling mill line B which is used for the carrying out of the method according to the invention. Also ferritic-austenitic steels are conceivable. Three methods of manufacturing the starting material are illustrated in the left hand part A of the drawings. According to method I, slabs 1 are hot rolled in a hot rolling mill line for the manufacturing of hot rolled strips with a thickness which can be normal for hot rolled strips, i.e. 1.5–6 mm. According to one aspect of the invention, however, the hot rolling is stopped before or at the latest when the thickness has been reduced to 2.5 mm, i.e. so that the strips obtain a thickness within the gauge range 3–6 mm, preferably a thickness between 3 and 5 mm. The hot rolled strips are quench-cooled to a temperature lower than 500° C. at a rate of at least 15° C./s in a quench-cooling section 3, suitably through intense water-spraying. Thereupon the strips are coiled into coils 4, which are caused to cool further to 100° C. or lower. Through the rapid cooling to below 500° C., precipitation of grain boundary carbides in the stainless steel strips are essentially avoided. Another effect attained through the rapid cooling is that those oxide layers which unavoidably are formed on the surfaces of the steel strip become thinner than what is normal in connection with hot rolling and slower cooling, particularly in connection with cooling after the strips have been coiled to form coils at a higher temperature.

According to method II stainless steel strips are cast to the shape of strips according to any technique which may be known per se and which as far as its specific mode of operation is concerned, does not form part of this invention and will therefore not be described more in detail. By way of example, however, there can be utilised so called stainless steel strip casting by twin rolls, which is a technique known by people skilled in the art. The cast stainless steel strip is hot rolled in a hot rolling mill line 2' to a thickness which is conventional for stainless, hot rolled strips, or somewhat larger, 3–6 mm, see above, whereupon the hot rolled strip immediately is quench-cooled in a cooling section 3 and is coiled to form a coil 4.

According to method III the stainless steel strip is cast in the shape of a strip having a thickness which is normal for stainless steel strips, or possibly somewhat larger, i.e. about 2.5–6 mm, whereupon the strip is quench-cooled in a cooling section 3' to a temperature below 500° C. at a rate which is sufficient to essentially avoid the formation of grain boundary carbides and for avoiding undesirably thick oxide scales on the surfaces of the strip, i.e. at a rate of at least 15° C./s. The thus produced strips are warned up on coils 4'.

The starting material for the subsequent operation in the rolling mill line B thus consists of the cast and/or hot rolled, stainless steel strips 4, 4'. Such a coil 4, 4' of a stainless steel strip is shown in the drawings as it is being decoiled from a decoiler 6. An auxiliary decoiler is designated 6A. A welding machine for splicing strips, a first strip looper, and a first multi-roll S-mill are designated 7, 8, and 9, respectively. Then follows an initial cold rolling section 10, consisting of three cold rolling mills 11, 12, and 13, which mills are of so called Z-high- or 6-high type, which means that each of them has a pair of working rolls and two support rolls over and under respective working roll.

After the initial cold rolling section 10 there follows a degreasing equipment 14, a second multi-roll S-mill 15 and a second strip looper 16.

The strip which has been decoiled from the coil 6 is designated 5 in the drawings. After having passed the initial cold rolling section 10, the strip is designated 5'. From the strip looper 16, the strip 5' is fist fed through a washing equipment 17 before it is fed into and through an annealing furnace 18 and a cooling section comprising two cooling chambers 19 and 20. Then there follows a third multi-roll S-mill 21, a shot blasting step 22 and a descaler 24. On each side of descaler 24 there is a fourth and a fifth multi-roll S-mill 23 and 25, respectively.

The furnace atmosphere in the furnace 18 may contain e.g. max 10% oxygen, preferably max 6% oxygen. A furnace atmosphere of that type can be obtained and maintained in different ways, e.g. and suitably by heating the furnace by means of burners which consume a liquid or gaseous fuel, which is combusted by means of a gas which contains at least 85 vol-% and not more than 10 vol-% nitrogen, as is disclosed in WO95/24509. Preferably, the combustion gas according to the known technique contains 99.5% oxygen. If propane is used as fuel and is combusted by means of a gas, which contains 99.5 vol-% oxygen, there will be obtained a furnace atmosphere, which contains about 40 vol-% carbon dioxide, 50 vol-% steam and totally 10% nitrogen and oxygen. In one case it was achieved according to this technique, which is known per se, a furnace gas which contained 39 vol-% CO2, 51 vol-% H2O, 6 vol-% N2, wherein the nitrogen emanated from air that was leaking in.

The descaler 24 consists of a cold stretch mill, the design of which is shown in detail in FIG. 3 in said EP 0 738 781, which herein is incorporated in the present description by reference. A cold stretch mill of that type comprises a series of rolls which force the strip to be bent alternatively in different directions, at the same time as the strip is permanently elongated through cold stretching. One has found that by means of a cold stretch mill of that type it is possible to achieve an efficient descaling without impairing the surfaces of the strip beneath the oxide layers.

After the descaler 24 there follows a pickling section, which e.g. can consist of an initial neolyte- or other electrolytic pickling section 26 and a mixed acid pickling section 27. The acid mixture e.g. may consist of a mixture of nitric acid, $HNO_3$, and hydrofluoric acid, HF. The pickled strip, which is designated 5", then can be stored in a third strip looper 28.

A further, terminating cold rolling mill is designated 32. This mill, according to the embodiment, consists of a four-high mill, i.e. a rolling mill with a couple of working rolls and a supporting roll over and under the working roll, respectively, allowing rolling with reductions by up to 15 to 20% depending on the type of stainless steel (austenitic or ferritic, the ferritic steels normally being possible to be rolled with a higher degree of reduction than austenitic steels). Alternatively the finishing cold rolling mill may consist of a two-high mill intended only for skin-pass-rolling. Subsequent to the rolling mill 32 there are provided a sixth multi-roll S-mill 33, a straightening mill 34, a drying unit 36, a seventh S-mill 36, and an edge cutting unit 37 before the strip 5'" is wound up to form a coil 40 on a coiler 38. An auxiliary coiler has been designated 38A.

Figure 2:
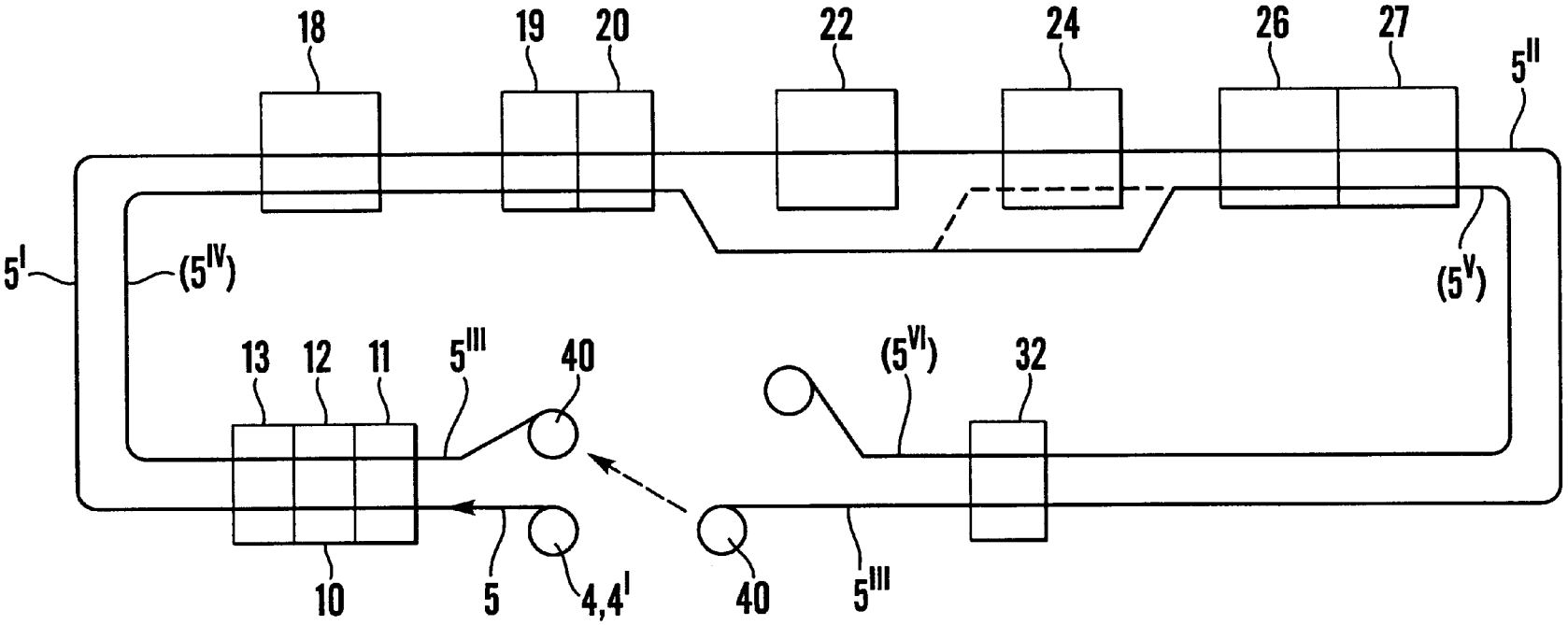

According to the various aspects of the invention, the stainless steel strip shall pass once or twice through the rolling mill line B. This will now be disclosed more in detail with reference to FIG. 2, in which only the most essential equipment have been shown, while other parts, such as a welding machine, S-mills, deflecting- and guide rollers, loopers, etc., have been left out in order that the principles of the invention shall be more clear. Reference numerals within brackets indicate strip material that is being processed as the material is passing the rolling mill line B for the second time.

The rolling in the rolling mill line B is initiated by unwinding the hot rolled or cast strip 5 of stainless steel from the coil 4, 4' of strip material. It then still has its dark, oxidic coating which it has obtained in the foregoing process in part A. This strip is cold rolled with a thickness reduction of totally at least 10% and max 75% in one, two, or all the three of the rolling mills 11, 12, 13 in the initial cold rolling section 10, preferably with 20–50% area reduction. The comparatively thin, dark oxide layers on the strip surfaces obtained at the quench-cooling after hot rolling or casting are so ductile that they are not broken apart through the cold rolling operations in the initial cold rolling section 10 to such a degree that they get loose from the substrate, i.e. from the metal surface. However, cracks are formed in the oxide layers, i.e. the scales on the steel strips crackle. This appears to be of essential importance for the subsequent pickling, the efficiency of which therein being promoted, which in its turn is important for the achievement of fine surfaces on the final product.

In the annealing furnace 18 the thus cold rolled strip 5' is annealed through heating to a temperature within the temperature range 1050–1200° C. for so long a period of time that the strip is through heated and recrystallised. As mentioned above, the furnace contains max 10 vol-% oxygen, preferably max 6 vol-% oxygen, but at the same time also a low content of nitrogen. More particularly, the furnace atmosphere consists substantially of carbon dioxide and steam due to the fact that the furnace is heated by means of burners which consume a liquid or gaseous fuel which is combusted by means of a gas which contains at least 85 vol-% oxygen and not more than 10 vol-% nitrogen. In this atmosphere in the furnace 18, those surface of the steel strips which are exposed through the fissures in the oxide, which have been established through the cold rolling in the initial cold rolling section 10, are oxidised only to an insignificant degree, which is favourable for the subsequent treatment.

In the cooling chambers 20 the strip 5' is cooled to below 100° C., before it is mildly shot-blasted in the shot-blasting section 22, which is a first measurement for the removal of oxides and scales from the strip surfaces. More particularly, oxides which lay loosely are removed through the shot-blasting in order not to spoil the subsequent descaling through accumulation of oxides.

The strip is passed and is stretch-elongated in the descaler 24 between a plurality of rolls under repeated bending, wherein the oxide scales are broken as another, preparatory measurement prior to the pickling in the pickling units 26 and 27, where the oxide scales are completely removed.

The thus pickled strip 5" then is cold rolled also in the terminating, additional cold rolling mill 32, which is dimensioned such that it can reduce the thickness additionally by up to 20%. Preferably the strip gauge reduction in the finishing cold rolling mill 32 is at least 2% and normally not more than 15%, suitably at least 8% and max 12%. The strip 5'" then is wound up to form a strip coil 40.

According to a first aspect of the invention then the strip is passed one more time through the rolling mill line B in the same direction as during the first pass. According to another aspect of the invention the obtained product may be the final product.

According to the first aspect of the invention the strip coil 40, after a period of time, which depends, among other things, on the logistic planning of the production in the plant, is transported to the decoiler 6 or 6A in the starting position of the rolling mill line, where the strip (5'") again is decoiled for the second passage of the strip through the rolling mill line B. While the strip during the first passage possibly only was rolled in one or two of the rolling mills 11–13 in the initial cold rolling section 10, it is this time rolled in two or three of the mills 11–13 so that it essentially achieves the desired final gauge of the strip. The total thickness reduction in the rolling mill section 10 at the second passage of the strip through this section depends on the desired final gauge and can amount to totally 60% and to at least 20%, preferably to at least 30%. After having passed the cold rolling section 10 for the second time, the cold rolling of the strip, now designated ($\mathbf{5}^{IV}$), is finished. The final treatment consists of again passing the strip through the annealing furnace 18, the cooling chambers 19 and 20 and the pickling sections 26 and 27. However, it is this time not at all treated in the shot-blasting unit 22 or in the descaler 24 according to an aspect of the invention. According to another aspect of the invention it is, however, also during the second passage through the rolling mill line treated in the descaler 24, the purpose in this case being to increase the yield strength of the strip through cold stretching. In the terminating cold rolling mill 32 it is then possibly rolled one more time, but this time it is only skin-pass rolled with a reduction thickness of 0.2–1.5%, preferably about 0.5%, in order to provide desired fine surfaces. The treatment of the strip ($\mathbf{5}^{VI}$) then is finished and the strip is coiled again. As an alternative, the strip ($\mathbf{5}^{V}$), instead of being skin-pass rolled, is rolled with the same heavy thickness reduction as when the strip was rolled for the first time in the terminating cold rolling mill 32, if the aim is to produce a strip with a very high yield strength.

The above description describes preferred embodiments according to different aspects of methods of using the rolling mill line B. It is a particular advantage of the design of the rolling mill line B that the rolling mill line or parts of it also can be used for processes which aims at manufacturing not only strips with very fine, bright surfaces but also strips with features which for some applications are of more significant importance than very bright surfaces, such as strips with high strength or strips with a lower degree of improvement but with advantages from a cost point of view. For the latter purpose, the treatment e.g. can be stopped already after the strip 5" has passed the pickling sections 26, 27 after the first passage of the first cold rolling section 10, the annealing and cooling sections, and the pickling sections. In the descaler 24 the strip can be cold stretched 2–10%, which provides a significant improvement of the strength. This treatment, however, also can be omitted, if such increase of the strength/yield strength is not desired. As an alternative the cold stretching can be replaced or completed by 2–20% cold rolling in the terminating cold rolling mill 32, which in that case is performed on non-lubricated surfaces, as the strip passes the terminating cold rolling mill a first time, whereafter the process is finished by coiling the strip. These examples and alternatives illustrate the versatility and adaptability of the rolling mill line to various wants as far as the final product is concerned.

EXAMPLE

A slab of stainless austenitic steel of grade ASTM 304 is hot rolled in a Steckel-mill to achieve a strip with a breadth of 1530 mm and a thickness of 4.0 mm. Immediately upon rolling, the strip is quench-cooled from a final rolling temperature of about 900° C. to below 500° C. for about 10 s by water spraying, whereafter the strip is coiled. Through the fast cooling prior to coiling, formation of grain boundary carbides are essentially avoided. At the same time also the dark oxide layers on the surfaces of the strip become comparatively thin.

The strip coil then is transported to the rolling mill line of the invention, is decoiled, and is first cold rolled with its dark oxide layers in two of the rolling mills 11–13 in the initial cold rolling section 10 to the thickness of 2.05 mm, wherein the oxide layers crackle, however without loosening. Thereafter the strip is annealed in the annealing furnace 18 in the atmosphere poor of oxygen, which has been previously described, at a temperature of 1120° C. for a sufficiently long period of time in order to be completely recrystallised, whereafter the strip is cooled to below 100° C. in the cooling chambers 19 and 20. Then the surfaces of the strip is shot-blasted in the shot-blasting unit 22 very mildly with steel shots, whereafter the strip is subjected to descaling in the stretch mill 24, before it is pickled, first through electrolytic pickling in the section 26 and then in mixed acid (mixture of nitric acid, $HNO_3$, and hydrofluoric acid, HF) in the pickling section 27. In the finishing cold rolling mill 32 the pickled strip then is cold rolled with a thickness reduction of 9.8% to gauge 1.85 mm, whereafter the strip is wound up on a coil.

The strip then is transported back to the start position. Due to the heavy cold rolling which the strip has been subjected to in the terminating cold rolling operation in the rolling mill 32 it has been deformation hardened to a considerable degree and it is therefore not easily damaged and can therefore be transported and handled without a risk that the strip surfaces shall be damaged. The strip thus again is decoiled and it is this time rolled in all the three rolling mills 11–13 in the initial cold rolling mill 10 with a total thickness reduction of 45.9% to gauge 1.0 mm. The strip is annealed, cooled, and then pickled in the same way as during the first passage through the rolling mill line but is not shot-blasted or cold stretched prior to pickling according to the example. Finally the strip is skin-pass rolled in the terminating cold roll mill 32, adding a further thickness reduction of about 0.5%, wherein the strip achieves a surface fineness Ra_0.12 $\mu$m, i.e. very well corresponding to 2B-surface.

As is apparent from the foregoing, the cold rolling mill of the invention is extremely versatile as far as its use for the manufacturing of stainless strips with very fine surfaces and/or for strips with other desirable qualities or desired features are concerned. In the following table, there will be listed a number of these alternative ways of manufacturing strips with reference to the utilisation of the various thickness reducing units which are included in the rolling mill line, i.e. the initial cold rolling mills, the descaler/cold stretching mill, which also can be used for reducing the thickness of the strip, and the cold rolling mill, or possibly a plurality of cold rolling mills, which terminate the line.

Examples of different alternatives concerning the use of the cold rolling mill line with reference to strip thickness reductions

| | First passage through the cold rolling line | | | Second passage through the cold rolling line | | | |
|---|---|---|---|---|---|---|---|
| Alternative | Cold rolling section 10 | Descaler/cold stretching mill 24 | Cold rolling mill 32 | Cold rolling section 10 | Descaler/coldstretching mill 24 | Cold rolling mill 32 | Achieved surface of the final product |
| 1 | Rolling in at least one of the mills 11, 12 and/or 13; 10–75%, preferably 20–50% total reduction | Permanent elongation 2—10% | Reduction of thickness 2–20%, preferably 3–15%, suitably 8–12% | Rolling in at least two of the mills 11, 12 and/or 13; 20–60% total reduction | — | Skin-pass rolling 0.2–1.5%; preferably about 0.5% reduction | At least 2B |
| 2 | Rolling in at least one of the mills 11, 12 and/or 13; 10–75%, preferably 20–50% total reduction | Permanent elongation 2—10% | — | Rolling in all the three mills 11, 12 and 13; 30–60% total reduction | — | Skin-pass rolling 0.2–1.5%; preferably about 0.5% reduction | At least 2B |
| 3 | Rolling in at least one of the mills 11, 12 and/or 13; 10–75%, preferably 20–50% total reduction | Permanent elongation 2—10% | Reduction of thickness 2–20%, preferably 3–15%, suitably 8–12% | Rolling in a least two of the mills 11, 12 and/or 13; 20–60% total reduction | Permanent elongation 2–10% | Hard rolling 2–20%, preferably 10–15% | At least 2B |

-continued

Examples of different alternatives concerning the use of the cold rolling mill line with reference to strip thickness reductions

| | First passage through the cold rolling line | | | Second passage through the cold rolling line | | | |
|---|---|---|---|---|---|---|---|
| Alternative | Cold rolling section 10 | Descaler/cold stretching mill 24 | Cold rolling mill 32 | Cold rolling section 10 | Descaler/ coldstretching mill 24 | Cold rolling mill 32 | Achieved surface of the final product |
| 4 | Rolling in at least one of the mills 11, 12 and/or 13; 10–75%, preferably 20–50% total reduction | Permanent elongation 2—10% | — | Rolling in all the three mills 11, 12 and 13; 30–60% total reduction | Permanent elongation 2–10% | Hard rolling 2–20%, preferably 10–15% | At least 2B |
| 5 | Rolling in at least one of the mills 11, 12 and/or 13; 10–75%, preferably 20–50% total reduction | Permanent elongation 2—10% | Hard rolling 2–20%, preferably 10–15% | — | — | — | Very good (almost 2B) |
| 6 | Rolling in at least one of the mills 11, 12 and/or 13; 10–75%, preferably 20–50% total reduction | Omitted or permanent elongation 0.5–5% | — | Rolling in at least two of the mills 11, 12 and/or 13; 30–60% total reduction | — | Skin-pass rolling 0.2–1.5%; preferably about 0.5% reduction or hard rolling 2–20%, preferably 10–15% | At least 2B |
| 7 | Rolling in at least one of the mills 11, 12 and/or 13; 10–75%, preferably 20–50% total reduction | Blasting + (optionally) permanent elongation 2–10% | — | — | — | — | Pickled surface |

What is claimed is:

1. Method for manufacturing of strips of stainless steel, comprising cold rolling of a strip which in a foregoing process has been manufactured through casting a melt to form a cast strip and/or has been hot rolled, wherein said cold rolling of the cast and/or hot rolled strip, which is dark colored by oxide scales on the surfaces of the strips, remaining from said foregoing process, is performed in one or more consecutive cold rolling passes (11–13) reducing the strip thickness by 10–75% and crackling the oxide scales to produce cracks in the oxide scales, and then annealing the strip in a furnace (18) having a furnace atmosphere obtainable by heating the furnace by means of burners which consume a liquid or gaseous fuel which is combusted by means of a gas which contains at least 85 vol-% oxygen and not more than 10 vol-% nitrogen.

2. Method according to claim 1, wherein the furnace atmosphere contains max 10 vol-% oxygen.

3. Method according to claim 1, wherein the strip is annealed in the furnace atmosphere at a temperature of 1050–1200° C. for a period of time such that the strip is through-heated and re-crystallised.

4. Method according to claim 1, wherein the thickness of the stainless strip is reduced by 20–50% in said initial cold rolling section (10).

5. Method according to claim 1, wherein the strip after annealing is cooled and subjected to descaling in at least one descaling unit (24), in which the strip is bent a plurality of times in different directions about rolls, at the same time as the strip is cold-stretched so that it is permanently elongated, causing the oxide scales to break prior to pickling the strip.

6. Method according to claim 5, wherein the strip is cold-stretched in said at least one descaling unit (24), so that it is permanently elongated 2–10%.

7. Integrated rolling mill line comprising:

in an initial part of the line, at least one cold rolling mill (11–13) for initial cold rolling of stainless steel strips with dark, oxidic surfaces obtained in connection with a foregoing casting and/or hot rolling of stainless steel strips;

at least one annealing section (18) after said cold rolling mill, said annealing section including an annealing furnace (18), which is heated by means of burners which consume a liquid or gaseous fuel which is combusted by means of a gas which contains at least 85 vol-% oxygen and not more than 10 vol-% nitrogen;

at least one pickling section (26, 27) after said annealing station; and a descaler (24) between the annealing and pickling sections in the form of a cold-stretching mill.

8. Integrated rolling mill line, comprising, in an initial part of the line, an initial cold rolling line (10) comprising at least two cold rolling mills (11–13) in series.

9. Integrated rolling mill line according to claim 8, wherein the initial cold rolling line (10) comprises cold rolling mills (11–13) in series.

10. Integrated rolling mill line according to claim 7, wherein said at least one cold rolling mill is able to reduce the thickness of a cast and/or hot rolled stainless steel strip by a total of at least 10 and max 75%.

11. Integrated rolling mill line according to claim 7, wherein each of the cold rolling mills in the initial part of the line comprises a pair of working rolls and at least two supporting rolls over and under respective working roll.

12. Integrated rolling mill line according to claim 7, wherein in the descaler (24) the strip is provided to be bent alternatingly in different directions about a plurality of rolls at the same time as the strip is permanently being stretched.

13. Integrated rolling mill line according to claim 7, further comprising a cold rolling mill in the terminating part of the line, which consists either of a four-high rolling mill, comprising a pair of working rolls and at least one supporting roll over and under respective working roll, or consists of a two-high rolling mill for skin pass rolling.

14. Method according to claim 1, wherein the furnace atmosphere contains max 6 vol-% oxygen.

15. Integrated rolling mill line according to claim 7, wherein said at least initial, or said at least two initial cold rolling mills in series, are provided to be able to reduce the thickness of a cast and/or hot rolled stainless steel strip by totally at least 20 and max 75%.

16. Method for manufacturing strips of stainless steel, comprising the steps of:

cold rolling a strip which has been manufactured in a foregoing process by casting a melt to form a cast strip and/or has been hot rolled, said foregoing process producing dark colored oxide scales on the surfaces of the strips, said cold rolling being conducted in one or more consecutive cold rolling passes reducing the strip thickness by 10–75% and crackling the oxide scales to produce cracks in said oxide scales; and annealing the strip in a furnace (18) having a furnace atmosphere obtainable by heating the furnace by means of burners which consume a liquid or gaseous fuel which is combusted by means of a gas which contains at least 85 vol-% oxygen and not more than 10 vol-% nitrogen.

* * * * *